US006477954B1

(12) United States Patent
Doherty

(10) Patent No.: US 6,477,954 B1
(45) Date of Patent: Nov. 12, 2002

(54) INK KEY PRESETTING SYSTEM FOR OFFSET PRINTING MACHINES

(75) Inventor: Neil Doherty, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 22 days.

(21) Appl. No.: 09/606,033

(22) Filed: Jun. 28, 2000

(51) Int. Cl.[7] ..... B41F 31/04
(52) U.S. Cl. ..... 101/365; 101/484
(58) Field of Search ..... 101/365, 364, 101/367, 483, 484, 492

(56) References Cited

U.S. PATENT DOCUMENTS 5,010,820 A * 4/1991 Löffler ..... 101/484
5,170,711 A 12/1992 Maier et al. ..... 101/365
6,318,260 B1 * 11/2001 Chu et al. ..... 101/365

FOREIGN PATENT DOCUMENTS

DE 3620152 C2 3/1994
EP 0 881 076 A1 12/1998
GB 2283834 A * 5/1995
GB 2283940 A * 5/1995
JP 1-141054 A * 6/1989

OTHER PUBLICATIONS

"Disseminating graphic arts research internationally since 1948", Technical Association of the Graphic Arts, 1998 Proceedings, pp. 335–371.

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

An inker of an offset printing press is preset in accordance with the image coverage distribution for an image to be printed. The image coverage distribution is obtained from a plate scanner or from a digital image setter file that is available during makeready. Whether in simulation or in actual print, the printed ink film commands are first set. Then inking operation is simulated and a simulated ink coverage distribution is obtained by driving a steady state error between the printed ink film commands and the ink coverage to zero. The presets are calculated in a proportional-integral controller with feedback from a simulated printing plant. The resulting ink key presets are then used to preset the ink keys of the inker at the start of the actual print job.

6 Claims, 4 Drawing Sheets open loop. start with empty inker.
desired ink level = 0.1

INK KEY PRESETTING SYSTEM FOR OFFSET PRINTING MACHINES

BACKGROUND OF THE INVENTION

Field of the Invention

The invention lies in the field of printing technology. More specifically, the invention pertains to ink supply control systems for web-fed and sheet-fed offset printing presses, and, in particular, to an ink key presetting system using a simulation of a printing unit with an ink film controller.

In offset printing, ink is supplied via an ink train, also referred to as the inker, from an ink fountain to a plate cylinder and then to a blanket cylinder, from which the ink is transferred to the print substrate (e.g. paper). The ink train includes an ink fountain roller, also referred to as an ink pickup roller, which picks up the ink at the ink fountain and transfers it to an ink ductor roller. The ductor roller oscillates between the ink fountain roller and an ink vibrator roller and thereby transfers the ink from the ink fountain roller to the vibrator roller. From there, the ink is transferred via distributor rollers to other vibrator rollers, which distribute the ink onto several ink form rollers. The ink form rollers ink the printing plate on the plate cylinder by depositing the ink onto the oleophilic surfaces on the plate. From there, the ink is transferred onto the rubber blanket in accordance with the image to be printed.

The amount of ink that is transferred is most important for the print quality. Too much ink in the ink train leads to smearing and blurring of the printed image. Too little ink leads to faint print and uneven distribution of ink color.

Different amounts of ink are required in various zones according to the image to be printed. In order to vary the ink feed laterally across the width of the inker, the ink supply leaving the ink fountain can be adjusted with ink keys. Each ink key thereby defines the ink supply for a respective zone. Depending on the type of printing unit, there may be provided any number of ink zones across the width of the inker. The number of ink zones and ink keys may vary from six to sixty, or even more.

The ink supply is subject to a vast number of variables. To begin with, due to the rheological characteristics of the ink, the relationship between the ink key feed gap and the amount of ink supplied at a given key is not linear. The type of printing ink, dampening agent, and paper, as well as process temperature and plant humidity influence the steady state behavior as well. Further, the various oscillating rollers in the ink train cause a substantial lateral distribution of the ink, so that the amount of ink supplied to a given zone at the rubber blanket is not only dependent on the ink key associated with that zone, but also on adjacent ink keys. In other words, as the ink travels from the ink fountain to the rubber blanket via several laterally oscillating vibrator rollers, a certain amount of ink bleeds from one zone to another. This phenomenon is referred to as the lateral coupling of the inker. Also, the final print application onto the substrate depends on the offset ratio, i.e., the ratio at which the ink is transferred from the rubber blanket onto the substrate (the ink film is split from the blanket, so that one part of the ink is transferred onto the paper and the other part is carried on by the blanket back into the inker). Typical ratios are 50:50, 30:70, 70:30, and so on.

The setpoint image coverage distribution is typically obtained from a plate scanner or a digital image setter file during makeready. However, due to the various system-dictated parameters, the actual setting for the ink key opening is substantially different from the setpoint ink film thickness. During the start of a printing job, therefore, a substantial amount of time passes before the inker is properly ready for the imprint. Also, when the plate cylinder and the rubber blanket are finally thrown on for imprint, a substantial number of signatures are passed through with improper ink coverage, thus leading to a substantial amount of waste.

SUMMARY OF THE INVENTION

It is accordingly an object of the invention to provide an ink key presetting system for offset printing machines, which overcomes the above-mentioned disadvantages of the heretofore-known devices and methods of this general type and which allows for more dependable and detailed makeready and enables ink-key presets that lead to quick and dependable preinking and printing machine runup with a minimum of waste.

With the foregoing and other objects in view there is provided, in accordance with the invention, a method of presetting an inker in an offset printing press, which comprises:

- inputting an image coverage distribution for an image to be printed;
- setting printed ink film commands in accordance with the image coverage distribution;
- simulating an inking operation for calculating a simulated ink coverage distribution, and thereby driving a steady state error between the printed ink film commands and the ink coverage to zero and obtaining ink key presets; and
- presetting the ink keys of the inker with the ink key presets at a start of an actual print job.

In accordance with an added feature of the invention, the ink coverage distribution is obtained by scanning with a plate scanner or from a digital (image setter) file.

In accordance with an additional feature of the invention, the inking operation is simulated as follows:

- all inker paths in the inker are discretized with equal sized segments by dividing with lateral segments and circumferential segments;
- the printing unit is advanced by one circumferential segment;
- an amount of ink on each element is calculated after traversing a nip between two roller;
- a lateral overlap of elements is calculated based on a lateral motion of a vibrator roll in a given inker path;
- the advancing and calculating steps are repeated for a desired number of revolutions of the plate cylinder in the inker path.

In accordance with another feature of the invention, the amount of ink is calculated as a mass of ink by summing the ink films entering the nip from incoming roller paths (conservation of mass principle) and then dividing the summed mass between the two rollers defining the nip according to a preset split ratio.

In accordance with a concomitant feature of the invention, the sum of ink entering the nip is a weighted sum of overlapping elements. The weighting is proportional to an amount of overlap.

With the above and other objects in view there is also provided, in accordance with the invention, an ink control system for an inker of an offset printing press, the inker including an ink fountain for supplying ink to an ink train in proportion to respective settings of a plurality ink keys each aligned with a respective inker path along which ink is transferred from the ink fountain to a substrate to be printed, and the ink train having a plurality of mutually nipping rollers including one or more vibrator rollers, a plate cylinder, and a blanket cylinder for imprinting a given image onto the substrate, the ink control system comprising:

a device receiving input data representing an image coverage distribution for an image to be printed;

the device being programmed:

to simulate a proportional-integral controller connected to a plurality of actuators each adjusting a setting of a key opening of a respective ink key of an ink fountain;

to set printed ink film commands in accordance with the image coverage distribution;

to simulate an inking operation for calculating a simulated ink coverage distribution, feed back printing plant information for calculating a steady state error between the printed ink film commands and the ink coverage, and drive the steady state error to zero and obtain ink key presets; and the device having an output outputting ink key presets of the inker representing the ink key presets at a start of an actual print job for printing the image.

In accordance with again another feature of the invention, there is provided a method of evaluating controller parameters for a given print job. The method comprises implementing the above-described method in a printing system with a closed loop color controller for evaluating controller parameters for a given print job, and optimizing the controller parameters of the printing system.

Other features which are considered as characteristic for the invention are set forth in the appended claims.

Although the invention is illustrated and described herein as embodied in an ink key presetting system for an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
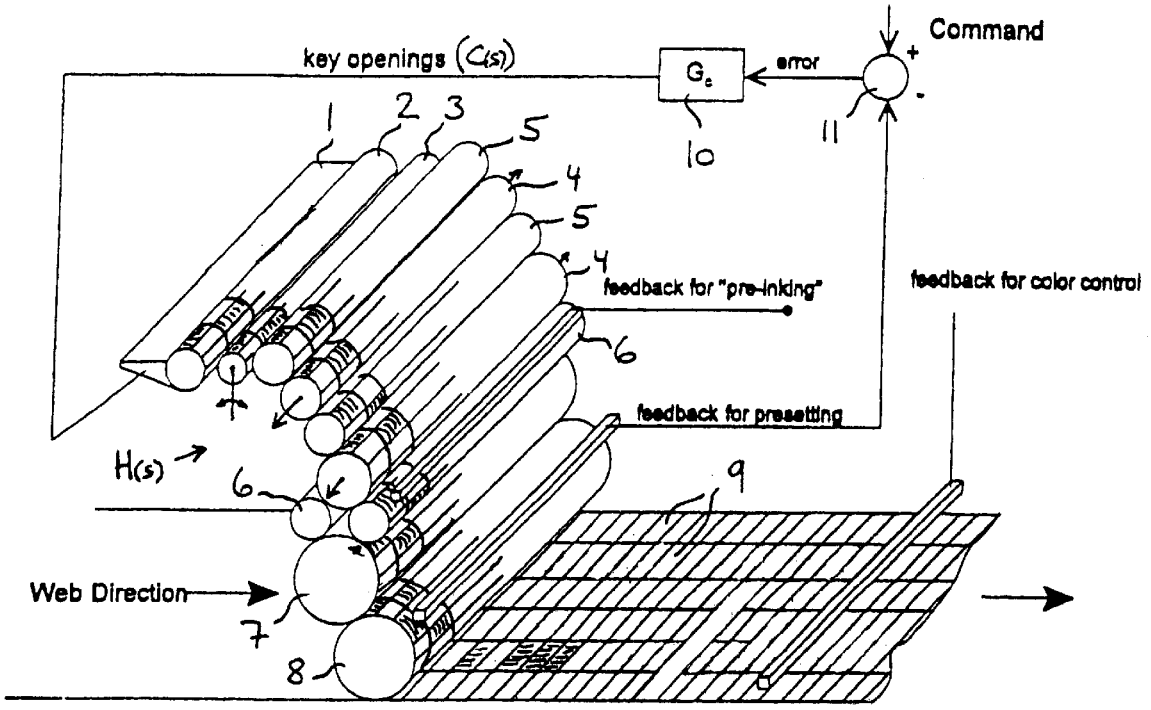
FIG. 1 is a partly schematic, perspective diagram of an inker of an offset printing machine with a color control preset system according to the invention.

Referring now to the figures of the drawing in detail and first, particularly, to FIG. 1 thereof, there is seen an upper ink train of an offset printing machine. The ink is dispensed at an ink fountain 1, which is provided with a flexible lower section composed of ink fountain blades. Ink keys control the opening of the ink fountain blades. The inker is divided into zones and each zone has one ink key. The invention will be described with six ink zones, i.e., with six ink keys along the lateral extent of the inker. As noted above, inkers in conventional offset printing machines may have any number of ink keys. By way of example, the invention has been tried in the context of a M1000BE by Heidelberg Web Systems, N.H., which has 24 ink keys.

The ink is picked up from the ink fountain 1 by an ink fountain roller 2. An ink duct or roller 3 oscillates between the ink fountain roller 2 and an ink transfer roller 5, which transfers onto an ink vibrator roller 4. The ink vibrator roller 4 oscillates laterally, i.e., longitudinally along its axis, so as to laminate the ink laterally and to maintain a constant ink temperature. Ink transfer rollers 5 link the various vibrator rollers 4 to one another. Form rollers 6, which are in contact with one or more ink transfer rollers 5, transfer the ink onto a printing plate on a plate cylinder 7. From there the ink is transferred onto a rubber blanket of a blanket cylinder 8 and onto a paper web 9.

The system is divided into zones s which lead to equal sized segments throughout all of the inker paths. These segments are discrete elements that can be processed in digitized or discretized format. The number of ink keys at the ink fountain 1 of the exemplary embodiment described herein defines six zones. Several zone fields are further defined about the periphery of the rubber blanket cylinder along its circumference.

It will be understood that, while the invention is described with reference to a web-fed offset printing press, it is equally applicable to sheet-fed presses.

A command for the printed ink film of each zone is entered into a controller 10. The controller 10 defines the ink key openings according to its transfer function $G_c$. The closed-loop system for the presetting obtains its error signal from a measuring bar which measures the ink thickness of each of the six zones at the rubber blanket 8.

In a pre-inking operation, the closed-loop system obtains its error signal feedback from a measurement at the form roller 6.

Figure 2:
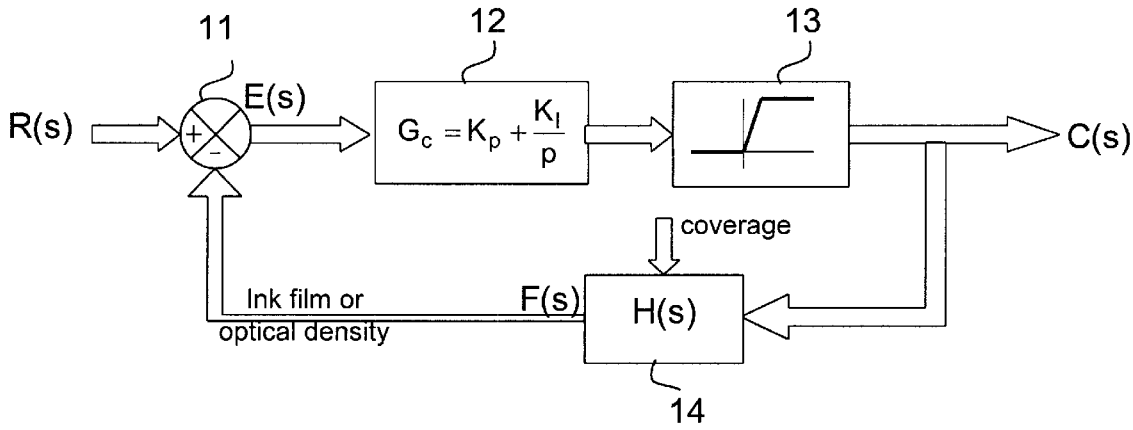
FIG. 2 is a system diagram of the feedback loop of the ink control system according to the invention.

The closed-loop block diagram of FIG. 2 illustrates a printing unit simulation with error signal feedback F(s). The commands for the printed ink films R(s) are entered via a summer 11. The signals are processed in a controller 12 for 10 the ink keys. The controller 12 in the exemplary embodiment is a proportional-integral (PI) controller with a transfer function $G_c$ that includes a proportional gain $K_p$ and an integrated term $K_I/p$, where $K_I$ represents the integral gain.

The term p represents a Laplace differential operator $$p \equiv \frac{d}{dt}$$

and the term 1/p represents the integral operator $$\frac{1}{p} \equiv \int_{0+}^{t} dt.$$

The integral operator represents the unit step 1 in the Laplace transform. The controller 12 is followed by a min-max limiter 13, which limits the controller output signals to the maximum setting (e.g. 20=fully opened) and minimum setting (zero=completely closed) of the ink key openings.

The feedback of the system is defined by a transfer function H(s) that includes the coverage input with reference to each zone s. The coverage represents the desired zonal coverage determined by the plate scanner or a digital image setter file. As will be seen from the following exemplary illustration, the controller system transfer function $G_c$ defines the final output signal C(s)—the ink key setting—both after the initializing simulation and the final color control preset calculation.

The transfer function H(s) represents the printing plant or printing unit that is being investigated. It may either be a simulation or an actual system. The output of the feedback 14 represents the actual ink film or optical density at the rubber blanket 8, or else the actually printed ink film.

The simulation for the function H(s) requires several inputs, which include:

- Inker configuration: the various roller diameters and the flow path, i.e., the ink exiting nips among the various rollers.
- Lateral vibrator roll parameters: the vibrator rollers 4 define the lateral coupling of the inker. The system thus includes vibrator roller information such as oscillation frequency, amplitude, and relative phase of motion.
- Split ratio: the split ratio defines the amount of ink that exits each nip, i.e., the division of the ink volume that remains on the first carrying roller to the ink volume that is transferred after exiting the nip.
- Ink feed mechanism parameters: the ink ductor roll which oscillates between the fountain roller and the inker roller is described by a ducting period, and the fractions of the period during which the ductor roll spends on the fountain roll and on the inker roll.
- Plate image layout: if the plate is discretized into, say, 30 lateral segments and 50 circumferential segments, the image information contains 1500 discrete segments each with a scaled coverage which may be in itself discretized or expressed in percent coverage (0 to 100%).
- Ink feed: in the exemplary embodiment, the ink feed refers to the ink film thicknesses on the fountain roll.

The signal C(s) represents the key openings of the ink keys at the ink fountain 1. The signal C(s) is formed by multiplying the proportional gain component of the transfer function $G_c$ with the error signal E(s), i.e. $C(s)=G_c \cdot E(s)$ where $E(s)=R(s)-H(s)C(s)$ and, and C(s) is limited to $0 \leqq C(s) \leqq 20$. If follows $$thG_c = K_p + \frac{K_I}{p}$$

at the actuator output signal $$C(s) = \frac{G_c(p)}{1 + GH(s)} R(s)$$

and the actuating error $$E(s) = \frac{1}{1 + GH(s)} R(s).$$

The controller parameters $K_p$ and $K_i$ are adjusted for the particular inker configuration to reduce the error and maintain stability. The transient response of the inker system depends on the speed at which the rollers 2–8 are driven, as well as the number of cooperating rollers. The object, of course, is to run the feedback signal F(s) (e.g., the ink film on the blanket) to R(s) by reducing the error signal E(s) to zero.

Figure 3:
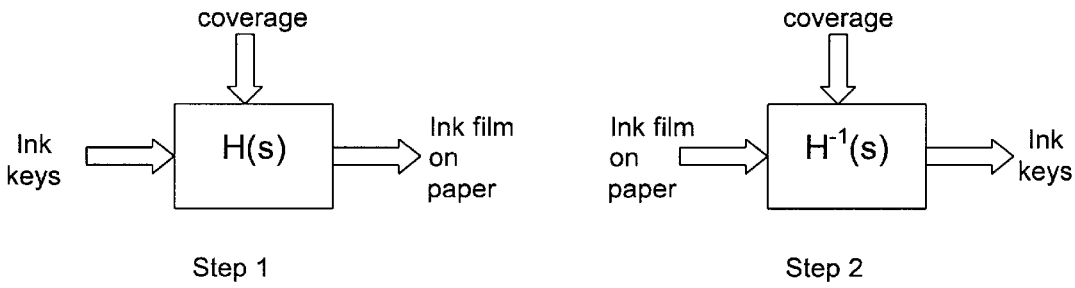
Fig. 3 Prior Art
FIG. 3 is a block diagram illustrating a prior art ink control system.

The closed-loop characteristics of the novel color control and preset system become even clearer when juxtaposed to a prior art preset system illustrated in FIG. 3. There, system transfer characteristics are estimated through simulation or experimental trials. The results of the trials are used to estimate the transfer matrix H(s). The matrix H(s) is then inverted to form $H^{-1}$ (s) to calculated ink key presets given the coverage and desired ink film on paper. The system transfer function H(s) for the inker is dependent on the image coverage distribution. The H(s) developed by this technique is an estimate. The technique used in the invention inherently inverts the actual system matrix by using a feedback system with high controller gain.

Figure 4:
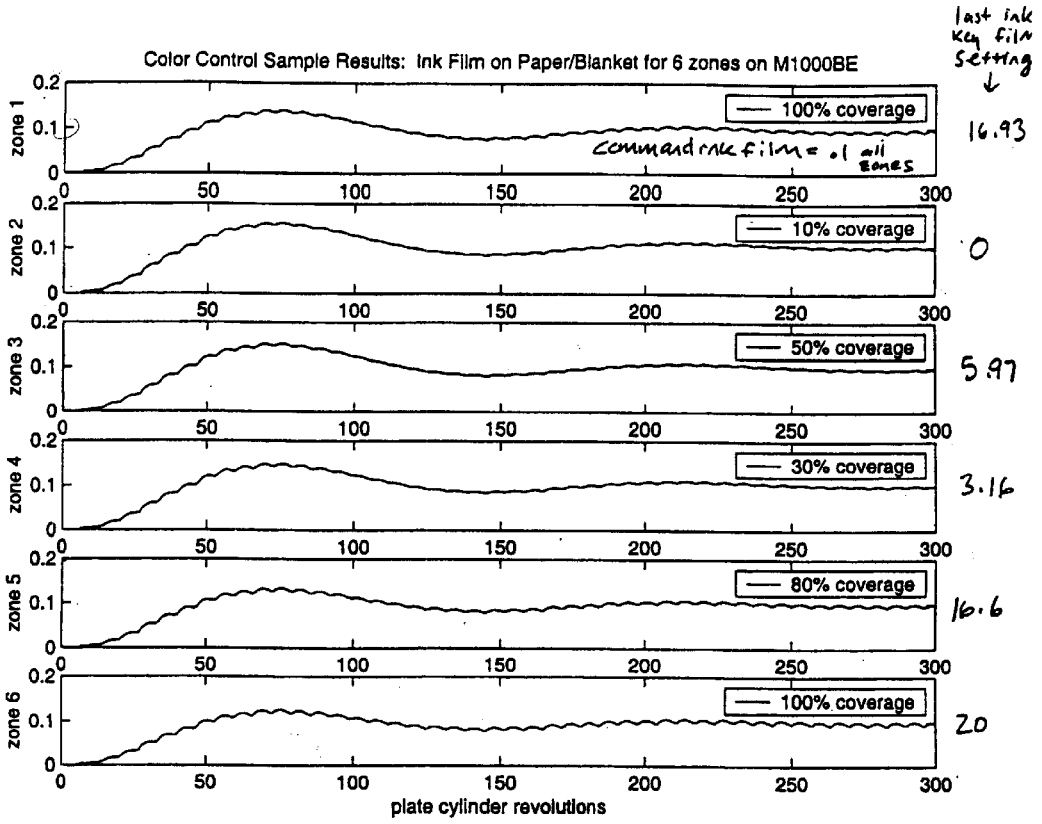
FIG. 4 is a graph showing color control samples on six zones.
Figure 5:
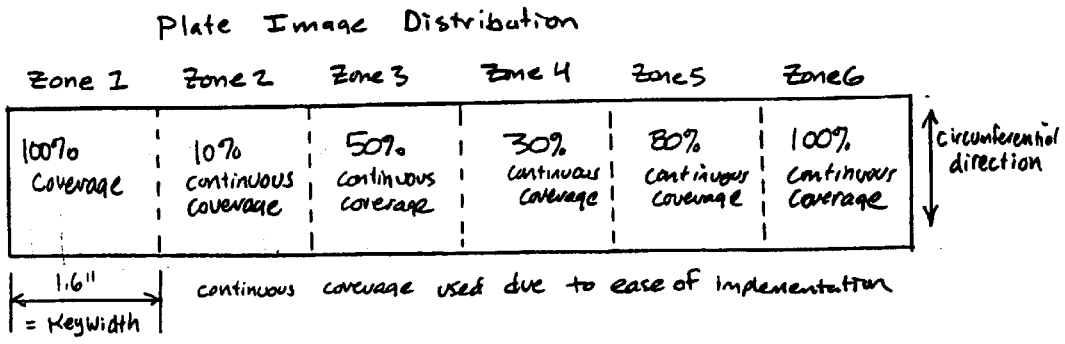
FIG. 5 is a diagrammatic view of an exemplary plate image distribution.

The simulation output of the invention represents the ink film printed on paper. If a split ratio of ½ (50:50) is assumed, then the ink film printed on the paper is the same film that exits to the blanket from the paper/blanket nip. Referring now to FIGS. 4 and 5 an ink control simulation was performed with six adjacent zones of the inker of an M100BE offset printing machine of Heidelberg Web Systems. For ease of implementation, continuous coverage was assumed on each of the six zones. The key width of the ink keys at the ink fountain is about 41 mm (1.6 inches). As illustrated in FIG. 5, the plate image distribution was acquired for the zones with the following percent coverages: 100, 10, 50, 30, 80, 100.

The primary prediction underlying the calculations was that there would not result a zeroth order deficiency such as stability in trying to control color online by measuring optical density (OD) and adjusting keys given the laterally varying ink demand and inherent lateral inker coupling. The simulation was performed with a transient inker simulation program, a software-controlled multivariable inker simulation. The ink thickness on the blanket was used as the closed loop feedback variable and each zone was subjected to the proportional-integral control action on the error via the transfer function $G_c$ (s) of the PI controller 12.

The first simulation, illustrated in FIG. 4, started with entirely closed ink keys in all six zones. The command printed ink film was set at 0.1 mils. The simulation graphed the ink film on the blanket (which corresponds in direct proportion to the ink film on the paper) over the number of full revolutions of the plate cylinder. A first overshoot was observed for all ink zones in the range from about 50 to 100 revolutions. The ink supply reaching the plate cylinder then went to deficit at about 150 revolutions. After a slight overshoot at about 230 revolutions, the system reached steady state ink supply conditions after about 260 revolutions. It is understood that both ink supply overshoot (smearing) and ink supply deficit (pale, blurred) are undesireable and lead to waste.

The unpredictability of the individual key settings for the various zones is evident from the final ink key film setting, as shown in the following table:

| | continuous coverage (in %) | Final ink key film setting = C(s) |
|---|---|---|
| zone 1 | 100 | 16.93 |
| zone 2 | 10 | 0.00 |
| zone 3 | 50 | 5.97 |
| zone 4 | 30 | 3.16 |

-continued

| | continuous coverage (in %) | Final ink key film setting = C(s) |
|---|---|---|
| zone 5 | 80 | 16.60 |
| zone 6 | 100 | 20.00 |

Figure 6:
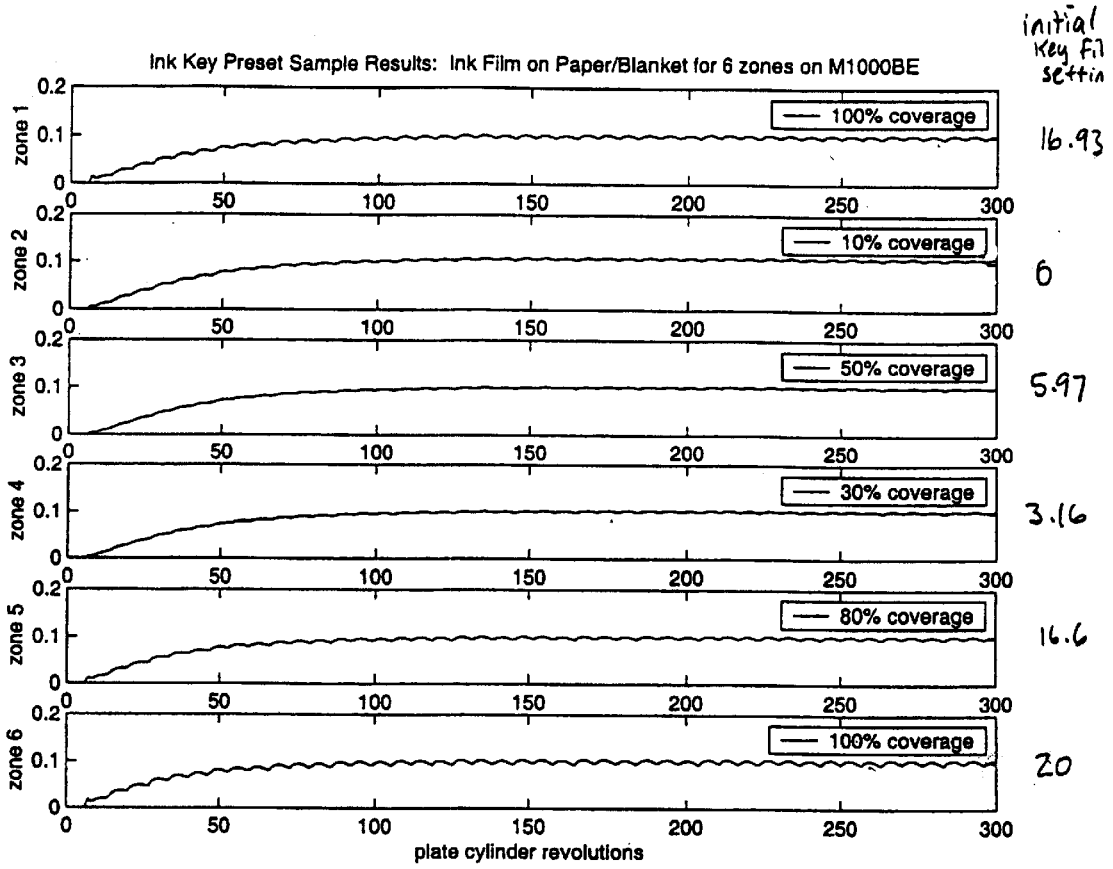
FIG. 6 is a graph showing an exemplary ink key preset system.

The final ink key settings obtained in the simulation were then used as the initial ink key film settings in a new run of the same process flow. The second run of the preinking process flow may be implemented once more in a simulation or in an actual preinking and presetting adjustment of the inker. The second run is graphed in FIG. 6. The process is open loop that starts with an empty inker. The desired ink level equals 0.1 mils. As shown, the system is no longer subject to an overshoot or ink supply deficit, but instead reaches the steady state setting at only about 100 revolutions of the plate cylinder.

The results obtained with the graphed simulations show that color control with the novel process is quite feasible. Any number of additional parameters and additional control schemes may be determined using simulations of specific machines based on first order principles.

As noted above, the color control simulation can be used to preset ink keys during make-ready. Once the simulation reaches steady state and predicted OD errors on the imagined substrate are minimized, the resulting key openings can then be used as actual presets. Typically, the presets may be obtained during make-ready, by inputting the necessary parameters including the desired coverage and printing ink characteristics into the processor. Typically, the processor program will have the necessary information regarding machine-specific parameters, such as the number and width of the ink keys, the actuator information, and the like.

While the exemplary embodiment is described in the context of a web-fed offset press, the system is equally applicable for sheet-fed presses. Also, the process is advantageous for preinking so as to assure that color is achieved quickly on startup by precharging the inker before the form rolls are on impression.

The ink film measurement for the feedback signal may be obtained by measuring the ink film at the rubber blanket. It is also possible to use films or optical density measurements at a location further downstream, such as at the chill rolls. In computing terms, the invention is implemented as follows:

a) All inker paths are discretized with equal sized segments.

b) The printing unit is advanced by one circumferential segment.

c) The ink on each element which has just "exited" a nip is calculated by applying conservation of mass principles. The ink exiting a nip is the sum of the films which entered from the incoming roller paths. The film splits to the two rolls according to the respective preset split ratios.

d) Lateral overlap of elements is calculated based on lateral motion of the vibrator roll. The sum of ink entering is considered the weighted sum of overlapping elements. The weighting is proportional to the amount of overlap.

e) Steps b) to d) are repeated for as many revolutions of the plate cylinder as desired.

Additional information with regard to the above described simulation may be found in a paper by Chou and Niemiro, "Computer simulation of Offset Printing:III. Effect of Ink Feed Mechanism" 1998 Proceedings of the Technical Association of the Graphic Arts (TAGA), which is herewith incorporated by reference.

I claim:

1. A method of presetting an inker in an offset printing press, which comprises:

inputting an image coverage distribution for an image to be printed;

setting printed ink film commands for a printed ink film in each lateral zone in accordance with the image coverage distribution;

simulating an inking operation for calculating a simulated ink coverage distribution, and thereby driving a steady state error between the printed ink film commands and the ink coverage to zero and obtaining ink key presets, by discretizing all inker paths in the inker with equal sized segments by dividing with lateral segments and circumferential segments, advancing the printing unit by one circumferential segment, calculating an amount of ink on each element after traversing a nip between two rollers, calculating a lateral overlap of elements based on a lateral motion of a vibrator roll in a given inker path, and repeating the advancing step and the calculating steps for a plurality of revolutions of a plate cylinder in the inker path; and presetting the ink keys of the inker with the ink key presets at a start of an actual print job.

2. The method according to claim 1, wherein the inputting step comprises scanning a printing plate with a plate scanner and determining the image coverage distribution.

3. The method according to claim 1, wherein the inputting step comprises inputting the image coverage distribution from a digital image setter file.

4. The method according to claim 1, wherein the step of calculating the amount of ink comprises calculating a mass of the ink by summing the ink films entering the nip from incoming roller paths and then dividing the summed mass between the two rollers defining the nip according to a preset split ratio.

5. The method according to claim 4, wherein the sum of ink entering the nip is a weighted sum of overlapping elements with a weighting being proportional to an amount of overlap.

6. A method of evaluating controller parameters for a given print job, which comprises implementing the method according to claim 1 with reference to a printing system with a closed loop color controller for evaluating controller parameters for a given print job, and optimizing the controller parameters of the printing system.

* * * * *